United States Patent [19]

Kotov

[11] 4,008,912

[45] Feb. 22, 1977

[54] SELF-TIGHTENING KNOT

[76] Inventor: Ilijus Kotov, 120 S. Herbert Road, Riverside, Ill. 60546

[22] Filed: Dec. 15, 1972

[21] Appl. No.: 315,306

[52] U.S. Cl. ..... 289/1.2; 289/1.5
[51] Int. Cl.[2] ..... D04G 5/00; B65H 69/04
[58] Field of Search ..... 289/17, 1.2, 1.5, 18

[56] References Cited

UNITED STATES PATENTS

| | | | |
|---|---|---|---|
| 2,992,029 | 7/1961 | Russell | 289/17 |
| 3,625,556 | 12/1971 | Stromberg | 289/17 |

FOREIGN PATENTS OR APPLICATIONS

| | | | |
|---|---|---|---|
| 518,606 | 3/1940 | United Kingdom | 289/18 |

OTHER PUBLICATIONS

"Encyclopedia of Knots and Fancy Rope Works" by R. Graumont and J. Hensel; 3rd Ed. 1945, Cl. 1943; Cornell Maritime Press; pp. 12 & 13.

*Primary Examiner*—Louis K. Rimrodt
*Attorney, Agent, or Firm*—Thomas W. Speckman

[57] ABSTRACT

A self-tightening knot for tying tubular casings such as sausage casings, cheese casings, or the like, comprises a doubled end portion of a flexible strand having a pair of substantially parallel strand segments and an end loop, a pair of overlapping bights in said end portion, and at least a pair of turns in said end portion between said bights. The end loop passes through said turns and holds the overlapping bights under at least one of said turns when the end loop is drawn taut and the knot is secured.

4 Claims, 1 Drawing Figure

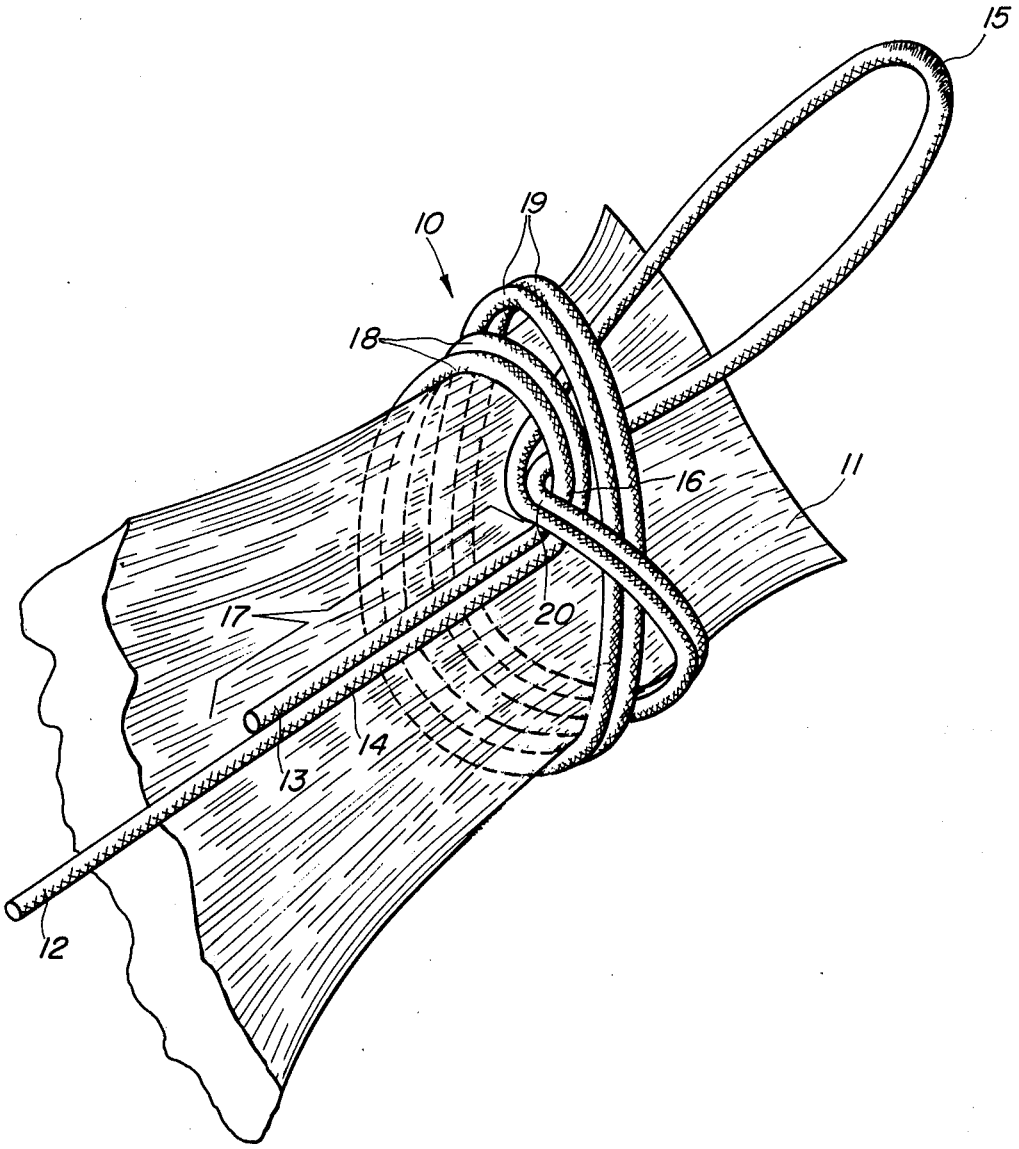
15
10
19
18
16
11
17
20
14
13
12

SELF-TIGHTENING KNOT

BACKGROUND OF THE INVENTION

This invention relates to a self-tightening knot for tying tubular casings.

Food products such as sausages, cheese, various sandwich spreads, and the like are often packaged in tubular casings the ends of which are tied or similarly secured. An object of the present invention is to provide a convenient means for tying tubular casings with a single flexible strand such as string, rope, cord, synthetic monofilaments, and the like.

A further object of the present invention is to provide a self-tightening knot as well as a method of producing a self-tightening knot.

Still other objects of the present invention will become apparent to the skilled artisan upon reference to the ensuing specification, the drawing, and the claims.

SUMMARY OF THE INVENTION

The present invention contemplates a self-tightening knot formed from a single strand of a material suitable for tying a tubular casing. The knot comprises a flexible strand provided with a doubled end portion comprising a standing part and a running part and having a pair of substantially parallel strand segments and an end loop. At least a pair of turns are formed in the running part of the doubled end portion and are wrapped about the tubular casing. A first bight is formed in the standing part of the doubled end portion and adjacent to the turns, and a second bight is formed in the running part of the doubled end portion between the turns and the end loop. The second bight overlies the first bight and the end loop passes through the turns so that both bights are situated under at least one of the turns as the end loop is drawn taut to secure the knot.

The terms "loop," "end," "turn," "standing part," and "running part" appearing herein and in the claims are used in accordance with the accepted definitions of these terms in standard dictionaries and handbooks on marlinespike techniques.

BRIEF DESCRIPTION OF THE DRAWING

In the drawing, the single FIGURE shows a perspective view of a partially formed self-tightening knot embodying the present invention.

DESCRIPTION OF THE PREFERRED EMBODIMENTS

Referring to the FIGURE, self-tightening knot 10 is tied on one end of tubular casing 11. Knot 10 is formed from single, flexible strand 12 one end of which is doubled over to provide substantially parallel strand segments 13 and 14 as well as end loop 15. First bight 16 is located in standing part 17 of the doubled end portion of strand 12. Turns 18 and 19 are wrapped about casing 11 and are in that segment of the doubled end portion of strand 12 which extends from bight 16 toward end loop 15 and which is generally referred to as the running part of the doubled end portion of strand 12. Second bight 20 is in the running part between turn 19 and end loop 15 and overlies first bight 16 in standing part 17. End loop 15, in turn, passes through turns 18 and 19 and positions overlying bights 16 and 20 under turn 19 as end loop 15 is drawn taut to secure knot 10 on casing 11.

In the embodiment shown in the FIGURE, two turns are formed in the running part of the doubled end portion of strand 12. However, three or more turns can also be formed if desired, without materially affecting the self-tightening qualities of the knot of this invention.

In tying knot 10, a single length of strand 12 is initially doubled over to form end loop 15 by placing strand segments 13 and 14 side by side. Next, first bight 16 is formed in standing part 17 of the doubled end portion and turns 18 and 19 are formed in the running part of the doubled end portion and wrapped tightly around casing 11. Thereafter end loop 15 is laid across turns 18 and 19, and second bight 20 is formed between turns 18 and 19 on one hand and end loop 15 on the other. After second bight 20 has been formed, end loop 15 is passed through turns 18 and 19 so that bight 20 overlies bight 16 and then is drawn taut, at the same time pulling bights 16 and 20 under turn 19 and securing knot 10 on casing 11. The resulting buildup of strand segments which are forced under turn 19, as end loop 15 is pulled tightly, further tightens the wrapping around casing 11 and generates a self-tightening effect. By a suitable selection of a resilient casing material as well as an elastic tying material a wide range of tightening or sealing effects can be obtained.

While in the foregoing specification this invention has been described in relation to certain preferred embodiments thereof, and many details have been set forth for the purpose of illustration, it will be apparent to those skilled in the art that this invention is susceptible to additional embodiments and that certain of the details described herein can be varied considerably without departing from the basic principles of the invention.

I claim:

1. A self-tightening knot formed from a single strand of a material for tying a tubular casing which comprises a flexible strand provided with a doubled end portion comprising a standing part and a running part and having a pair of substantially parallel strand segments and an end loop;

at least a pair of turns in the running part of said doubled end portion and about said casing;

a first bight in the standing part of said doubled end portion and adjacent to said turns; and a second bight in the running part of said doubled end portion between said turns and said end loop;

said second bight formed by passing said running part from the turn toward the end of said casing over all other turns toward the inner portion of said casing and beneath all turns toward the end of said casing providing said end loop to the end of the casing, said first bight formed by passing said standing part from the turn toward the inner portion of said casing under the running part forming said second bight and toward the inner portion of said casing.;

2. The self-tightening knot of claim 1 wherein two turns are provided in the running part of said doubled end portion and about said casing.

3. A method of producing a self-tightening knot for tying a tubular casing which comprises the steps of providing a single flexible strand;

doubling an end portion of said strand so as to form a standing part and a running part and to provide a pair of substantially parallel strand segments and an end loop;

forming a first bight in the standing part of the doubled end portion;

forming at least a pair of turns in said running part extending from said first bight toward the end and about said casing;

laying said end loop across the formed turns toward the inner portion of said casing;

forming a second bight in the running part of the doubled end portion between said turns and said end loop;

passing said end loop through the formed turns toward the end of said casing so that said second bight overlies said first bight; and drawing said end loop taut so as to pull said first bight and said second bight under at least one of said turns and so as to secure the produced knot.

4. The method in accordance with claim 3 wherein two turns are formed in the running part of the doubled end portion and about said casing.

* * * * *